US009623991B2

(12) United States Patent
Zhu

(10) Patent No.: US 9,623,991 B2
(45) Date of Patent: Apr. 18, 2017

(54) AUTOMATIC PACKING MACHINE

(71) Applicant: FUSHIRUI PRECISION INDUSTRY (ZHENGZHOU) CO., LTD., Zhengzhou (CN)

(72) Inventor: Yong-Gang Zhu, Shenzhen (CN)

(73) Assignee: FUSHIRUI PRECISION INDUSTRY (ZHENGZHOU) CO., LTD., Zhengzhou (CN)

( * ) Notice: Subject to any disclaimer, the term of this patent is extended or adjusted under 35 U.S.C. 154(b) by 334 days.

(21) Appl. No.: 14/454,987

(22) Filed: Aug. 8, 2014

(65) Prior Publication Data

US 2015/0040522 A1 Feb. 12, 2015

(30) Foreign Application Priority Data

Aug. 9, 2013 (CN) ..... 2013 1 03456454

(51) Int. Cl.

| | |
|---|---|
| ***B26D 1/04*** | (2006.01) |
| ***B26D 7/01*** | (2006.01) |
| ***B26D 7/18*** | (2006.01) |
| ***B65B 35/18*** | (2006.01) |
| ***B65B 57/14*** | (2006.01) |
| ***B65B 35/30*** | (2006.01) |
| ***B65B 5/06*** | (2006.01) |

(52) U.S. Cl.

CPC ..... *B65B 35/18* (2013.01); *B26D 1/045* (2013.01); *B26D 7/01* (2013.01); *B26D 7/1863* (2013.01); *B65B 5/068* (2013.01); *B65B 35/30* (2013.01); *B65B 57/14* (2013.01)

(58) Field of Classification Search

CPC ..... B26D 1/045; B26D 7/01; B26D 7/1863; B65B 5/068; B65B 35/30; B65B 57/14; B65B 35/18

USPC ..... 53/513

See application file for complete search history.

(56) References Cited

FOREIGN PATENT DOCUMENTS

| | | |
|---|---|---|
| CN | 2718755 Y | 8/2005 |
| JP | 2009004652 A | 1/2009 |

*Primary Examiner* — Andrew M Tecco
*Assistant Examiner* — Praachi M Pathak
(74) *Attorney, Agent, or Firm* — Steven M. Reiss

(57) ABSTRACT

Automatic packing machine for thin or small workpieces can include a supporting plate, a transferring belt, a cutting assembly, a vacuum-lifting assembly, and a packing assembly. The edge of the transferring belt has a plurality of positioning holes and carries the workpieces. The cutting assembly can include a cutting subassembly with a lifting mouth and a positioning subassembly including a rotating drive member and a pulling member. The toothed peripheral edge of the pulling member is driven to rotate by the rotating drive member, thereby the teeth of the pulling member are successively latched into the positioning holes of the transferring belt, and the transferring belt is pulled. The workpieces are successively aligned with the lifting mouth so that the cutting subassembly can cut the workpiece from the transferring belt. The vacuum-lifting assembly lifts and transfers the workpiece to packing.

10 Claims, 5 Drawing Sheets

AUTOMATIC PACKING MACHINE

FIELD

The present disclosure relates to packing machines, and more particularly, to an automatic packing machine for thin workpieces.

BACKGROUND

Workpieces which are thin or small often need to be fixed to a transferring belt to be washed or transferred. A packing machine is used to pack the workpiece in a feed tray. A conventional packing machine can include a cutting assembly, a vacuum-lifting assembly, and a packing assembly. The cutting assembly cuts the side of the transferring belt where it is connected with the workpiece, and separates the workpiece from the transferring belt. The lifting assembly lifts the workpiece by a vacuum pump, and transfers the workpiece to the packing assembly. The packing assembly packs the workpiece in the feed tray. It is difficult to accurately position the workpiece on the transferring belt before the cutting assembly. Thus, the cutting assembly cannot always with reliable precision separate the workpiece from the transferring belt. In addition, the lifting assembly can shift when attempting to lift the workpiece, air leaks between the vacuum-lifting assembly and the workpiece can sometimes cause further errors in the precise locating of the workpiece.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

This disclosure is illustrated by way of example and not by way of limitation in the figures of the accompanying drawings in which like reference numbers indicate similar elements. It should be noted that references to "an" or "one" embodiment in this disclosure are not necessarily to the same embodiment, and such references mean "at least one."

Figure 1:
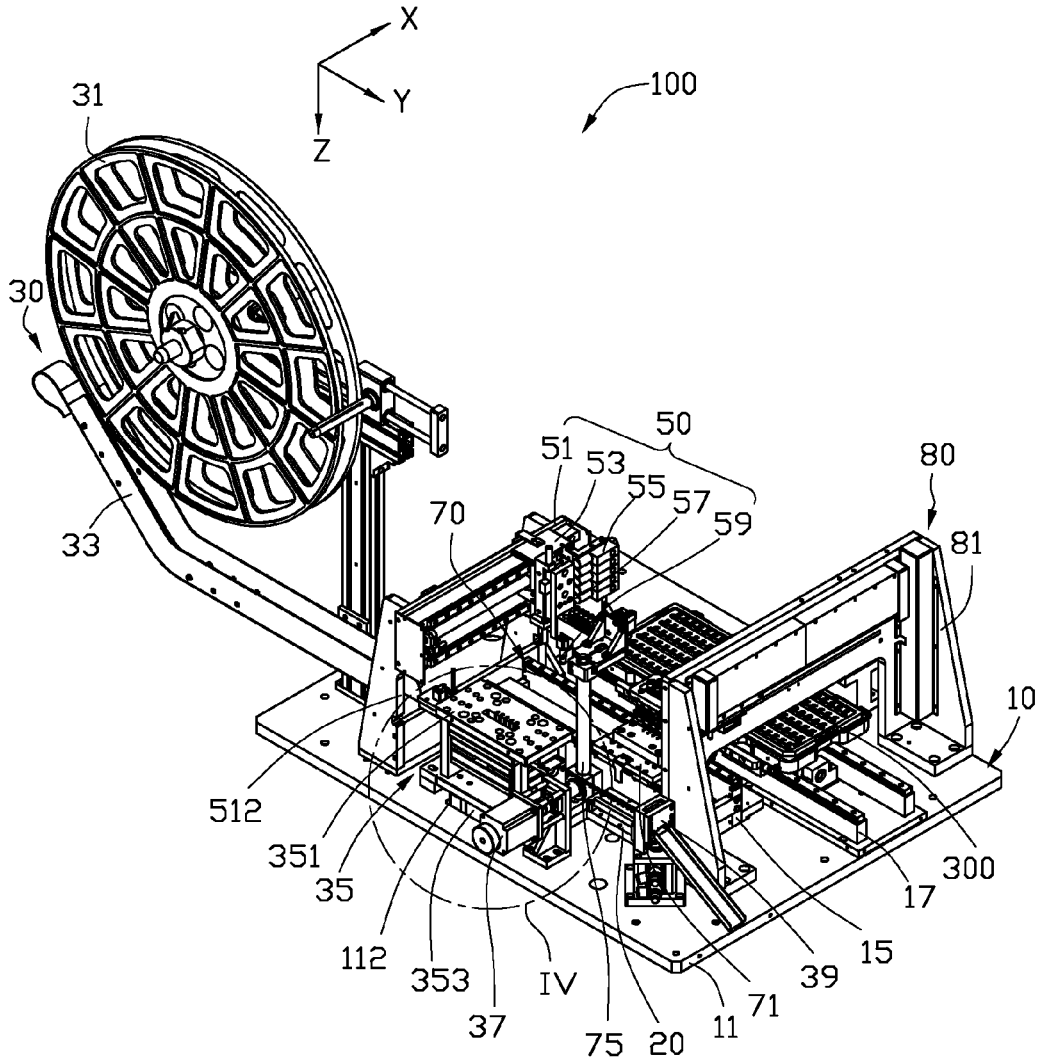
FIG. 1 is a front perspective view of an automatic packing machine according to an illustrated embodiment of this disclosure.
Figure 2:
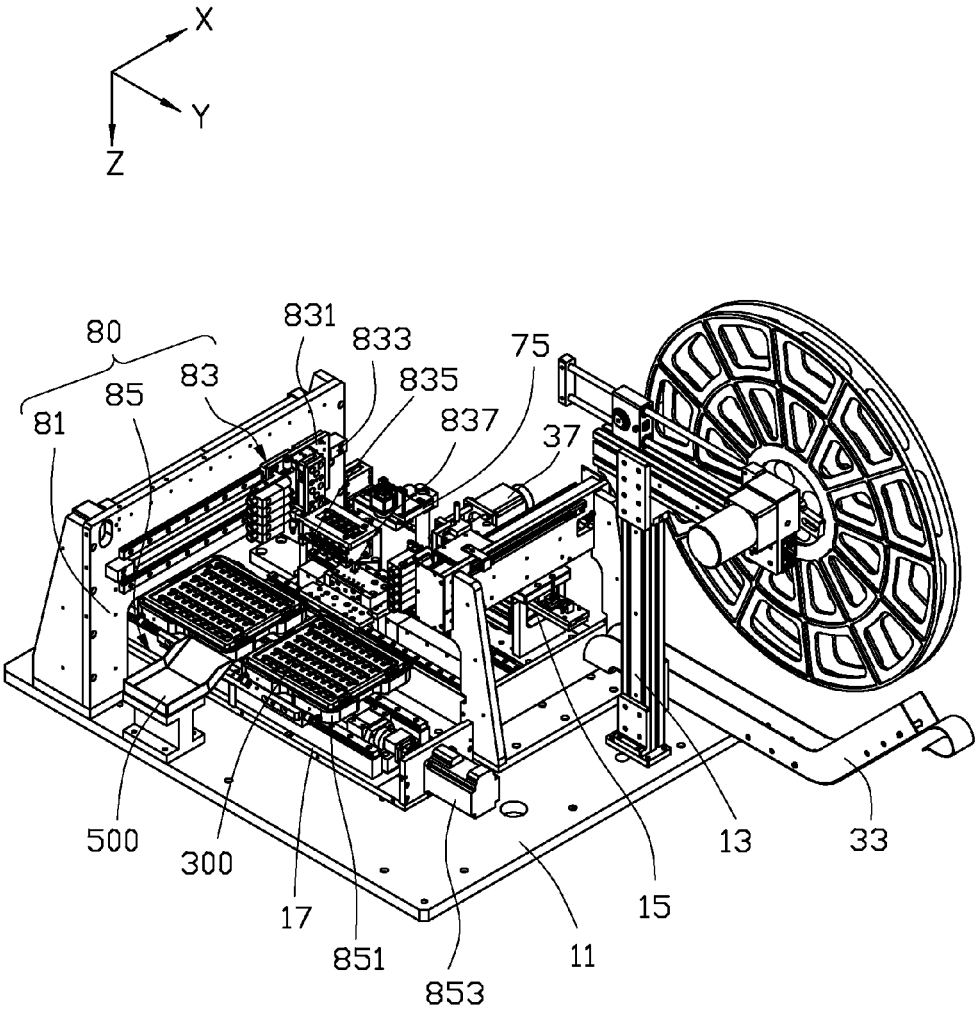
FIG. 2 is a back perspective view of the automatic packing machine as shown in FIG. 1.

FIG. 1 and FIG. 2 illustrate an automatic packing machine 100 in an illustrated embodiment of this disclosure. The automatic packing machine 100 can be configured to transfer a workpiece 200 (see FIG. 3) to a feed tray 300 for packing. The automatic packing machine 100 can include a base unit 10, a transferring belt 20, a cutting assembly 30, a vacuum-lifting assembly 50, a detecting assembly 70, a packing assembly 80, and a controller (not shown). The cutting assembly 30, the vacuum-lifting assembly 50, the detecting assembly 70, and the packing assembly 80 can be mounted on the base unit 10. The transferring belt 20 can be movably arranged on the cutting assembly 30. The cutting assembly 30 can be configured for cutting one side of the transferring belt 20 when the workpiece 200 is supported, and separating the workpiece 200 from the transferring belt 20. The vacuum-lifting assembly 50 can be configured for lifting and transferring the workpiece 200 to the detecting assembly 70. The detecting assembly 70 is configured to detect the workpiece 200 and determine if it is acceptable. The packing assembly 80 is configured to transfer the acceptable workpieces 200 to the feed tray 300, and transfer defective workpieces 200 to a scrap tray 500. The controller is electrically connected with the cutting assembly 30, the vacuum-lifting assembly 50, the detecting assembly 70, and the packing assembly 80, and is configured for controlling the vacuum-lifting assembly 50, the detecting assembly 70, and the packing assembly 80.

The base unit 10 can include a supporting plate 11, a fixing member 13, a first guide rail 15, and a second guide rail 17. The supporting plate 11 is a rectangular plate with a through hole 112. The fixing member 13 is vertically mounted on one side of the supporting plate 11. The second guide rail 17 and the first guide rail 15 are parallel and spaced from each other, and mounted on the supporting plate 11 along the Y axis.

Figure 3:
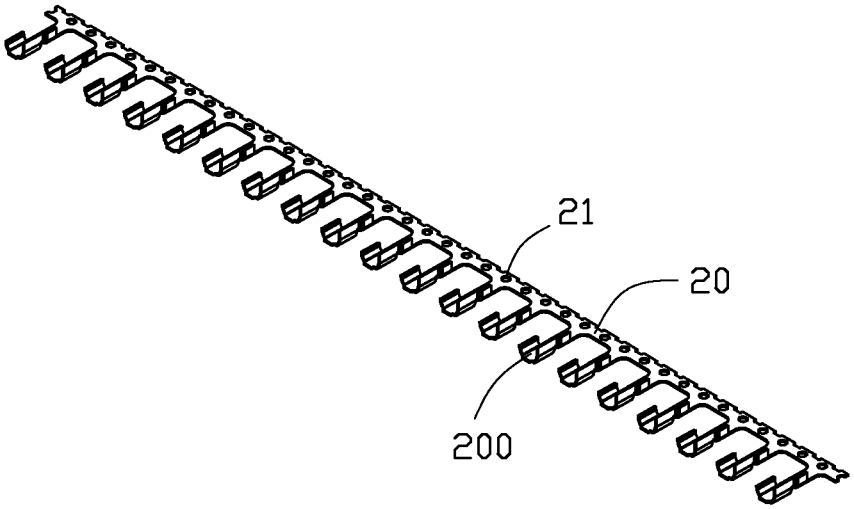
FIG. 3 is a perspective view of a transferring belt and workpieces on the transferring belt in the automatic packing machine as shown in FIG. 1.

FIG. 3 illustrates the workpieces 200 on one side of the transferring belt 20 and spaced from each other. The transferring belt 20 can define a plurality of positioning holes 21 therethrough, and the positioning holes can be arranged adjacent to one side of each workpiece 200.

Figure 4:
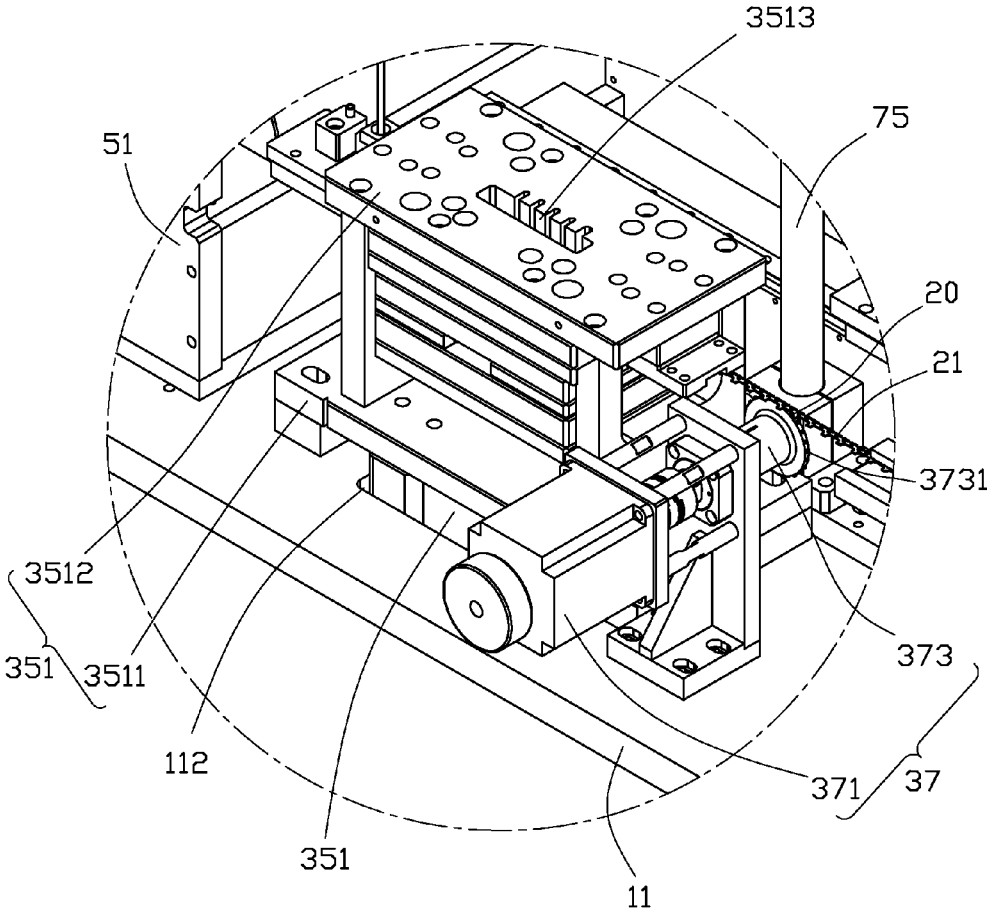
FIG. 4 is an enlarged view of an encircled portion IV of FIG. 1.
Figure 5:
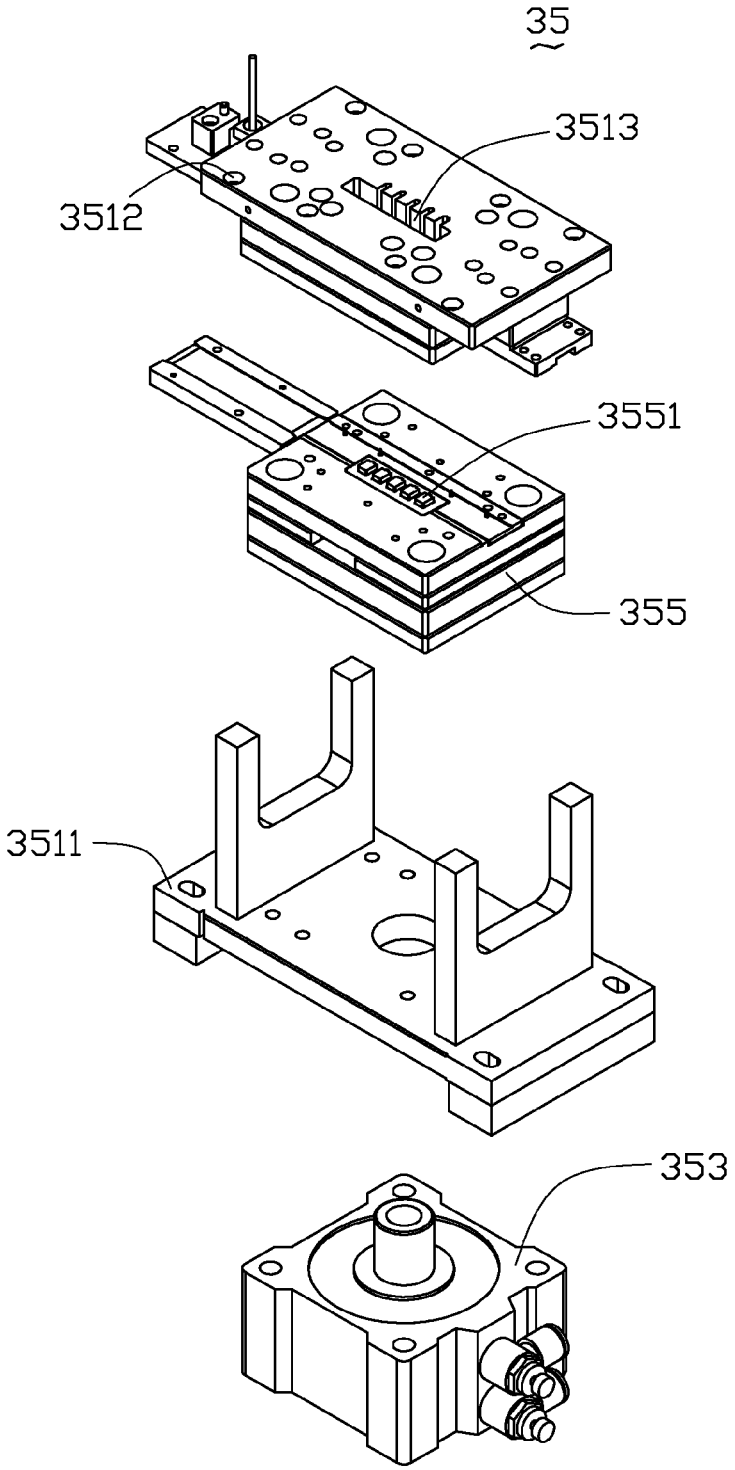
FIG. 5 is an exploded view of a cutting assembly as shown in FIG. 4.

FIG. 4 and FIG. 5 illustrate the cutting assembly 30 mounted on the supporting plate 11 near the fixing member 13. The cutting assembly 30 can include a reel disc 31, a guide member 33, a first cutting subassembly 35, a positioning subassembly 37, and a second cutting subassembly 39. The reel disc 31 can be mounted on one end of the fixing member 13 away from the supporting plate 11. The reel disc 31 can rotate on the fixing member 13. The transferring belt 20 is configured to carry the workpieces 200 wound onto or unwound from the reel disc 31. The guide member 33 can be mounted on the fixing member 13 for guiding the transferring belt 20 onto the reel disc 31 to be transferred to the first cutting subassembly 35. The first cutting subassembly 35 can be mounted on the supporting plate 11 near the through hole 112, and can include a first bracket 351, a first drive member 353, and a cutting member 355. The first bracket 351 can include a base 3511 and a top plate 3512 mounted on the base 3511. The base 3511 can be mounted above the through hole 112, and the top plate 3512 can define a vacuum-lifting hole 3513 therethrough. The first drive member 353 can be mounted in the though hole 112, and partially passes through the base 3511. The cutting member 355 can be movably mounted between the base 3511 and the top plate 3512, and connected to the first drive member 353. One side of the cutting member 355 near the top plate 3512, can include a plurality of cutting edges 3551. The transferring belt 20 passes through the space between the top plate 3512 and the cutting member 355. The cutting member 355 moves along the Z axis when driven by the first drive member 353, and the cutting edge 3551 cuts the workpiece 200 away from the transferring belt 20.

FIG. 4 illustrates the positioning subassembly 37 mounted on the supporting plate 11 near the first cutting subassembly 35. The positioning subassembly 37 can include a rotating drive member 371 and a pulling member 373 connected with the rotating drive member 371. The rotating drive member 371 can be mounted on the supporting plate 11 near the first cutting subassembly 35. The pulling member 373 can be toothed gear shaped, and a plurality of regularly-spaced latching portions 3731 can be arranged on the peripheral edge thereof. When driven by the rotating drive member 371, the pulling member 373 rotates relative to the transferring belt 20, and the latching portions 3731 can be successively latched into the positioning holes 21, thus the transferring belt 20 is pulled, and the workpieces 200 on the transferring belt 20 can be successively transferred to accurately align with the vacuum-lifting hole 3513. The second cutting subassembly 39 is mounted on the supporting plate 11 near the pulling member 373, and is configured for cutting the transferring belt 20 to be collected and transferred.

FIG. 1 illustrates that the vacuum-lifting assembly 50 can include a second bracket 51, a sliding member 53, a first line drive member 55, a second drive member 57, and a first sucking member 59. The second bracket 51 can be mounted on the supporting plate 11, vertical to the first bracket 351 and between the guide member 33 and the first cutting subassembly 35. The second bracket 51 can define an opening 512, whereby the transferring belt 20 on the guide member 33 can move into the first cutting subassembly 35 through the opening 512. The sliding member 53 can be mounted on the second bracket 51 so as to be able to slide. The first line drive member 55 can be mounted on the second bracket 51 and connected with the sliding member 53, thus the sliding member 53 can slide along the X axis when driven by the first line drive member 55. The second drive member 57 can be mounted on the sliding member 53. The first sucking member 59 can be connected with the second drive member 57, thereby the first sucking member 59 can move along the Z axis when driven by the second drive member 57, and move along the X and Z axes when driven by the first line drive member 55 and the second drive member 57, so as to pass through the vacuum-lifting hole 3513 and transfer the workpiece 200 to the detecting assembly 70. In the illustrated embodiment, the first sucking member 59 can be a vacuum generator.

The detecting assembly 70 can include a positioning member 71, a second line drive member (not shown), and a detecting member 75. The positioning member 71 can be substantially a rectangular plate, and slidably mounted on the first guide rail 15 to position the workpiece 200. The second line drive member can be mounted on the guide rail 15 and connected to the positioning member 71. The positioning member 71 can slide along the Y axis relative to the first guide rail 15 when driven by the second line drive member. The detecting member 75 can be mounted on the supporting plate 11 near the first guide rail 15, and can be configured to detect the workpiece 200 on the positioning member 71 and sending data of the result of the detection to the controller.

The packing assembly 80 can include a third bracket 81, a feeding subassembly 83, and a tray transferring subassembly 85. The third bracket 85 can be mounted on the supporting plate 11, parallel to the first bracket 51 and above the second guide rail 17. The feeding subassembly 83 can be mounted on the first bracket 81, and can include a moving parts 831, a third line drive member 833, a third drive member 835, and a second sucking member 837. The moving parts 831 can slide on the third bracket 81. The third line drive member 833 can be fixedly mounted on the third bracket 81 and connected to the moving parts 831, whereby the moving parts 831 can slide along the X axis when driven by the third line drive member 833. The third drive member 835 can be mounted on the moving parts 831. The second sucking member 837 can be connected with the third drive member 835. When driven by the third line drive member 833 and the third drive member 835, the second sucking member 837 slides along the X and Z axis to lift the workpiece 200 onto the positioning member 71, and places the eligible product in the feed tray 300 while placing defective products in the scrap tray 500. The tray transferring subassembly 85 can be mounted on the second guide rail 17, and can include a supporting member 851 and a fourth line drive member 85. The supporting member 851 can slide on the second guide rail 17 to support the feed tray 300. The fourth line drive member 853 can be mounted on the second guide rail 17 and connected to the supporting member 851. When driven by the fourth line drive member 853, the supporting member 851 slides along the Y axis relative to the second guide rail 17 to transfer the feed tray 300 to a position under the feeding subassembly 83, whereby the workpiece 200 is transferred to the feed tray 300 driven by the third line drive member 833, the third drive member 835, and the fourth line drive member 853. In the illustrated embodiment, the second sucking member 837 is also a vacuum generator.

The controller can be electrically connected with the first drive member 353, the rotating drive member 371, the first line drive member 55, the second driver 57, the detecting member 75, the second line drive member, the third line drive member 833, the third drive member 835, and the fourth line drive member 853. The controller controls the first drive member 353, so that the first drive member 353 drives the cutting member 355 to move along the Z axis so as to cut the workpiece 200 on the transferring belt 20. The controller controls the rotating drive member 371, the pulling member 373 rotates relative to the transferring belt 20 when driven by the rotating drive member 371, and the latching portions 3731 can be successively latched into the positioning holes 21 to pull the transferring belt 20, whereby the workpieces 200 on the transferring belt 20 can be one after another accurately aligned with the vacuum-lifting hole 3513. The controller controls the first line drive member 55 and the second drive member 57, so that the sucking member 59 moves along the X and Y axis when driven by the first line drive member 55 and the second drive member 57, and passes through the vacuum-lifting hole 3513 to lift and transfer the workpiece 200 to the detecting subassembly 70. The controller controls the second line drive member to drive the positioning member 71 to move along the Y axis relative to the first guide rail 15. The controller controls the third line drive member 833 and the third drive member 835 according to the results of detections. When the workpiece 200 is acceptable, the controller controls the third line drive member 833 and the third drive member 835, and the second sucking member 837 can be driven to move along the X and Z axis, so as to lift the workpiece 200 onto the positioning member 71, and place the workpiece 200 in the feed tray 300. The controller controls the fourth line drive member 853, and the supporting member 851 moves along the Y axis relative to the second guide rail 17 driven by the fourth line drive member 853, so that the feed tray 300 can be transferred below the feed subassembly 83.

In operation, one end of the transferring belt 20 on the reel disc 31 is transferred to the second cutting subassembly 39 through the first cutting subassembly 35, and the positioning subassembly 37. Then, the pulling member 373 rotates relative to the transferring belt 20 which is driven by the rotating drive member 371, and the latching portions 3731 successively catch in the positioning holes 21 to pull the transferring belt 20, so that the workpieces 200 on the transferring belt 20 can be one after another accurately aligned with the vacuum-lifting hole 3513. After that, the first sucking member 59 moves along the X and Y axis driven by the first line drive member 55 and the second drive member 57, and first sucking member 59 passes through the vacuum-lifting hole 3513 to lift and transfer the workpiece 200 to the positioning member 71 of the detecting assembly 70. The pulling member 373 rotates relative to the transferring belt 20 driven by the rotating drive member 371, the latching portion 3731 escapes from the positioning holes 21 of the transferring belt 20. The transferring belt 20 moves relative to the first cutting subassembly 35, so that the next workpiece 200 can be accurately aligned with the vacuum-lifting hole 3513, and next latching portion 3731 can be inserted into next positioning hole 21. Then, the positioning member 71 slides along the Y axis relative to the first guide rail 15 driven by the second line drive member, and the detecting member 75 detects the workpiece 200 on the positioning member 71 to adjust if it is a good product, and sends the detection result data to the controller. The controller controls the third line drive member 833 and the third drive member 835 according to the data. When the workpiece 200 is satisfactory, the second sucking member 837 slides along the X and Z axis driven by the third line drive member 833 and the third drive member 835, so as to lift and position the workpiece 200 on the feed tray 300. Finally, the supporting member 851 moves along the Y axis relative to the second guide rail 17 driven by the fourth line drive member 853, so as to transfer the feed tray 300 to the position below the feed subassembly 83. As a result, the workpieces 200 can be successively received in the feed tray 300 to be packed.

The automatic packing machine 100 in the illustrated embodiment can include the vacuum-lifting assembly 50, the cutting assembly 35, and the positioning assembly 37. The positioning assembly 37 can include the rotating drive member 371 and the pulling member 373, and the pulling member 373 can include a plurality of latching portions 3731. When driven by the rotating drive member 371, the pulling member 373 rotates relative to the transferring belt 20, and the latching portions 3731 can be successively caught in the positioning holes 21 on the transferring belt 20. The transferring belt 20 is pulled, and the workpieces 200 on the transferring belt 20 can be successively and accurately aligned with the vacuum-lifting hole 3513, so that the vacuum-lifting assembly 50 can lift the workpiece 200 to an accurate position. The workpiece 200 does not shift, the possibility of air leaks between the vacuum-lifting assembly 50 and the workpiece 200 is reduced, and the cutting assembly 35 can precisely cut the workpiece. The efficiency of sucking and cutting can be improved.

The cutting assembly 30 cuts the workpiece 200 from the transferring belt 20. The vacuum-lifting assembly 50 lifts and transfers the workpiece 200 to the detecting assembly 70. The detecting assembly 70 detects the quality of the workpiece 200, and the packing assembly 80 packs the satisfactory workpieces 200 according to the results of detection and transfers unsatisfactory workpieces 200 to the scrap tray 500.

The detecting assembly 70 can be omitted, and the vacuum-lifting assembly 50 can transfer the workpiece 200 to the feed tray 300. The second cutting subassembly 39 can be omitted, and the transferring belt 20 after cutting the workpiece 200 can be directly collected. The guide member 33 can be omitted, and one end of the transferring belt 20 on the reel disc 31 can pass directly through the first cutting subassembly 33 and the positioning subassembly 37.

It is believed that the present embodiments and their advantages will be understood from the foregoing description, and it will be apparent that various changes can be made thereto without departing from the spirit and scope of the embodiments or sacrificing all of its material advantages.

What is claimed is:

1. An automatic packing machine, configured for transferring a workpiece to a feed tray for packing, comprising:

a supporting plate;

a transferring belt, wherein the transferring belt carries a plurality of workpieces spaced apart from each other at a side and defines a plurality of positioning holes adjacent to the plurality of workpieces;

a cutting assembly mounted on the supporting plate, wherein the cutting assembly comprises a reel disc, a cutting subassembly, and a positioning subassembly;

the reel disc is positioned and can rotate on the supporting plate, the transferring belt is wound onto the reel disc and extends through the cutting subassembly;

the cutting subassembly defines a vacuum-lifting hole thereon;

the positioning subassembly comprises a rotating drive member and a pulling member connected with the rotating drive member;

the rotating drive member is positioned near the cutting subassembly, and the peripheral edge of the pulling member defines a plurality of regularly-spaced latching portions;

the rotating drive member drives the pulling member to rotate, whereby the latching portions of the pulling member are successively latched into the positioning holes of the transferring belt, and the transferring belt is pulled;

the workpieces on the transferring belt are accurately aligned with the vacuum-lifting hole successively so that the cutting subassembly can cut down the workpiece from the transferring belt; and a vacuum-lifting assembly and a packing assembly mounted on the supporting plate, wherein the vacuum-lifting assembly is capable of moving into the vacuum-lifting hole to lift the workpiece and transferring the workpiece to the packing assembly, wherein the packing assembly is configured for packing the workpiece in the feed tray.

2. The automatic packing machine as claimed in claim 1, wherein the supporting plate defines a through hole;

the cutting subassembly comprises a first bracket, a first drive member, and a cutting member, the first bracket is mounted on the supporting plate above the through hole, the vacuum-lifting hole passes through the first bracket, the first drive member is mounted in the through hole, and partially movably mounted through the first bracket; the cutting member is movably mounted on the first bracket and connected with the first drive member;

the transferring belt extend through the first bracket and above the cutting member; when driven by the first drive member, the cutting member moves relative to the first bracket to cut down the workpiece from the transferring belt.

3. The automatic packing machine as claimed in claim 2, wherein the automatic packing machine further comprises a fixing member vertically mounted on the supporting plate; the reel disc is mounted on the fixing member and can rotate on the fixing member;

the cutting subassembly further comprises a guide member mounted on the fixing member configured for guiding the transferring belt to the cutting subassembly.

4. The automatic packing machine as claimed in claim 1, wherein the vacuum-lifting assembly comprises a second bracket, a sliding member, a first line drive member, a second drive member, and a first sucking member;

the second bracket is mounted on the supporting plate, the sliding member being slidely mounted on the second bracket, the first line drive member is mounted on the second bracket and connected with the sliding member, thereby the sliding member can slide along a first direction driven by the first line drive member;

the second drive member is mounted on the sliding member, the first sucking member is connected with the second drive member, the first sucking member can slide along a second direction vertical to the first direction driven by the second drive member, whereby the first sucking member can slide along the first direction and the second direction driven by the first line drive member and the second drive member, and pass through the vacuum-lifting hole to suck the workpiece.

5. The automatic packing machine as claimed in claim 4, wherein the automatic packing machine further comprises a first guide rail mounted on the supporting plate;

the detecting assembly comprises a positioning member, a second line drive member and a detecting member, the positioning member is slidely mounted on the first guide rail to transfer the workpiece to the detection assembly;

the vacuum-lifting assembly transfers the workpiece to the positioning member;

the second line drive member is mounted on the first guide rail and connected with the positioning member, whereby the positioning member can slide relative to the first guide rail driven by the second line drive member; the detecting member is mounted on the supporting member near the first guide rail, and is configured to determine if it is acceptable.

6. The automatic packing machine as claimed in claim 5, wherein the automatic packing machine further comprises a second guide rail parallel with the first guide rail;

the packing assembly comprises a third bracket and a feed subassembly;

the third bracket is mounted on the supporting plate and above the second guide rail;

the feed subassembly comprises a moving parts, a third line drive member, a third drive member, and a second sucking member; the moving parts being slidely mounted on the third bracket, the third line drive member is fixedly mounted on the third bracket and connected with the moving parts; the third driving member is mounted on the moving parts, the second sucking member is connected with third drive member, thus the second sucking member can slide along the first direction and the second direction driven by the third line drive member and the third drive member, so as to lift the workpiece onto the positioning member.

7. The automatic packing machine as claimed in claim 6, wherein the packing assembly comprises a tray transferring subassembly, and the tray transferring subassembly comprises a supporting member and a fourth line drive member; the supporting member being slidely mounted on the second guide rail way to support the feed tray; the fourth line drive member is mounted on the second guide rail and connected with the support member, thereby the supporting member can move along the first direction and a third direction vertical to the second direction driven by the fourth line drive member, in order to transfer the feed tray to a position above the feed subassembly.

8. The automatic packing machine as claimed in claim 6, wherein the first sucking member and the second sucking member are vacuum generators.

9. The automatic packing machine as claimed in claim 1, wherein the automatic packing machine further comprises a controller connected with the cutting assembly, the vacuum-lifting assembly, the detecting assembly, and the packing assembly, configured for controlling the cutting assembly, the vacuum-lifting assembly, the detecting assembly, and the packing assembly.

10. The automatic packing machine as claimed in claim 1, wherein the pulling member is gear shaped.

* * * * *